US010973287B2

(12) United States Patent
Weissenbacher

(10) Patent No.: US 10,973,287 B2
(45) Date of Patent: Apr. 13, 2021

(54) EYELASH JEWELRY

(71) Applicant: Ingrid Weissenbacher, Perwang am Grabensee (AT)

(72) Inventor: Ingrid Weissenbacher, Perwang am Grabensee (AT)

( * ) Notice: Subject to any disclaimer, the term of this patent is extended or adjusted under 35 U.S.C. 154(b) by 125 days.

(21) Appl. No.: 16/470,065

(22) PCT Filed: Dec. 14, 2017

(86) PCT No.: PCT/EP2017/082933
§ 371 (c)(1),
(2) Date: Jun. 14, 2019

(87) PCT Pub. No.: WO2018/109132
PCT Pub. Date: Jun. 21, 2018

(65) Prior Publication Data

US 2020/0077753 A1 Mar. 12, 2020

(30) Foreign Application Priority Data

Dec. 14, 2016 (EP) ..... 16204187

(51) Int. Cl.
*A44C 15/00* (2006.01)

(52) U.S. Cl.
CPC ..... *A44C 15/0045* (2013.01); *A44D 2203/00* (2013.01)

(58) Field of Classification Search
CPC .... A41G 5/02; A44C 15/0045; A44C 15/005; A44D 2203/00
USPC ..... 63/3.1
See application file for complete search history.

(56) References Cited

U.S. PATENT DOCUMENTS

2007/0227550 A1* 10/2007 Merszei ..... A41G 5/02 132/53
2016/0206031 A1 7/2016 Stoka
2019/0216152 A1* 7/2019 Francis ..... A41G 5/0073

FOREIGN PATENT DOCUMENTS

FR 2299829 A1 * 9/1976 ..... A44C 7/00
WO 9308712 A1 5/1993
WO WO-9308712 A1 * 5/1993 ..... A44C 7/00
WO WO-2019093577 A1 * 5/2019 ..... A45D 44/02

* cited by examiner

*Primary Examiner* — Jack W Lavinder

(57) ABSTRACT

A piece of eyelash jewelry is disclosed, having a jewelry substrate, which has a first magnetic means with a first holding surface, and having a fastening part, which has a second magnetic means with a polarity that is opposite from that of the first means and has a second holding surface, the two magnetic means of the jewelry substrate and fastening part being embodied such that by means of magnetic interaction, they clamp at least one eyelash that can be placed between their opposing holding surfaces in order to thus fasten the piece of eyelash jewelry to the eyelashes. In order to increase the reliability of the piece of eyelash jewelry, it is proposed that the jewelry substrate have a flange, which protrudes from the first holding surface and thus forms a stop for the fastening part.

11 Claims, 2 Drawing Sheets

EYELASH JEWELRY

FIELD OF THE INVENTION

The invention relates to a piece of eyelash jewelry having a jewelry substrate, which has a first magnetic means with a first holding surface, and having a fastening part, which has a second magnetic means with a polarity that is opposite from that of the first means and has a second holding surface, the two magnetic means of the jewelry substrate and fastening part being embodied such that by means of magnetic interaction, they clamp at least one eyelash that can be placed between their opposing holding surfaces in order to thus fasten the piece of eyelash jewelry to the eyelashes.

BACKGROUND OF THE INVENTION

The prior art (US 2016/0206031 A1) has disclosed a device for fastening false eyelashes to the lashes of an eye in which two substrates with magnetic means are each provided with false eyelashes as decoration elements and are positioned above and below the lashes of an eye so that the magnetic means of the substrates cooperate in order to secure it to the eyelashes. Such devices, however, are comparatively large and put a relatively heavy weight load on the eyelashes. In addition, such devices have only a limited suitability for durably fastening small jewelry elements or decoration elements to the eyelashes, which when being detached from the eyelashes, can pose a comparatively high risk of injury to the eye.

SUMMARY OF THE INVENTION

The object of the invention, therefore, is to improve a piece of eyelash jewelry to such an extent that small jewelry or decoration elements can be secured to the eyelashes in a reliable way and as a result, the risk of injury can be reduced.

The invention attains the stated object in that the jewelry substrate has a flange, which protrudes from the first holding surface and thus forms a stop for the fastening part.

If the jewelry substrate has a flange, which protrudes from the first holding surface and thus forms a stop for the fastening part, then the stop formed by the flange can durably counteract a pull-off force acting on the jewelry substrate in the direction of the eye. It is thus possible to prevent an unwanted detachment of the jewelry substrate in the direction of the eye, which significantly reduces the risk of injury. Among other things, the flange can also constitute a rotation prevention means in a circular jewelry substrate, which prevents an unwanted rotation and can durably secure the orientation of the jewelry substrate in connection with the fastening part. It is thus possible to ensure that a jewelry or decoration element provided on the jewelry substrate is always oriented facing away from the eye and thus always facing toward an outside observer. To durably affix the piece of eyelash jewelry to the eyelashes, preferably at least one eyelash is clamped between the jewelry substrate and the fastening pan. Not least, it is thus also possible for one or more eyelashes to be positioned between the fastening pan and the stop of the flange on the jewelry substrate—and for the fastening part to thus touch the flange indirectly via the eyelashes. Furthermore, the flange according to the invention can enable a facilitated positioning of the holding means.

If the flange protrudes from the first holding surface inclined at an angle, in particular orthogonally, then it is possible to achieve a particularly reliable pull-off prevention and rotation prevention means relative to the fastening part. It is thus possible to achieve a particularly durably positioned and safer piece of eyelash jewelry. In general, it should be noted that the flange in this case can protrude from the holding surface at different angles. It is thus possible to produce a piece of eyelash jewelry with a particularly versatile jewelry substrate.

The piece of eyelash jewelry can also especially feature a simple design if the jewelry substrate has a jewelry or decoration element that constitutes the flange. This can also achieve a piece of eyelash jewelry that is simple and inexpensive to produce.

The piece of eyelash jewelry can feature a simple design if the holding surfaces are comprised of magnetic poles of the respective magnetic means.

If the jewelry substrate has a base from which the flange protrudes and which has the first holding surface, then it is possible to produce a jewelry substrate with a particularly simple design—which is also easy to manufacture.

The design simplicity of the jewelry substrate can be further improved if the first magnetic means constitutes the base.

If the first magnetic means is a permanent magnet, then it is possible to increase the magnetic holding force produced by the first magnetic means and consequently to produce a more reliable piece of eyelash jewelry. For example, a neodymium/iron/boron magnet can excel in this connection.

If the fastening part is also embodied as elongated, in particular rod-shaped, then the weight of the fastening part can be durably supported by a plurality of eyelashes. A length of the fastening part of at least 5 mm excels in this connection. It is thus possible to effectively prevent a load-induced flexing of the eyelashes under the load of the fastening part, which makes it possible to achieve a secure anchoring of the fastening part to the lashes of the eyelid. It is thus possible to achieve a particularly reliable fastening part.

The use of the piece of eyelash jewelry can be facilitated if the fastening part has a third magnetic means with a third holding surface, which is provided on the side of the fastening part opposite from the second holding surface. The fastening part can thus be used on both sides for fastening the jewelry substrate since both the second holding surface and the third holding surface on the fastening part can be oriented toward the first holding surface on the jewelry substrate—and the corresponding magnetic means cooperate via the respective holding surfaces to secure the piece of eyelash jewelry to the lashes of the eye.

If the fastening part is composed of at least one magnetic foil or metal foil, then it is likewise possible to achieve a reliable and simply designed fastening part. The magnetic foil or metal foil in this case can have not only enough flexibility so that it can be adapted to the contour of the eyelashes, but also enough rigidity that an unwanted and/or load-induced deformation of the fastening part can be durably prevented.

Compact structural conditions can be achieved if the jewelry substrate is embodied as L-shaped or T-shaped in cross-section. Such a design also makes the piece of eyelash jewelry easier to use.

BRIEF DESCRIPTION OF THE DRAWINGS

The subject of the invention is shown in greater detail in the figures by way of example based on an embodiment variant. In the drawings.

DETAILED DESCRIPTION OF THE PREFERRED EMBODIMENTS

Figure 1:
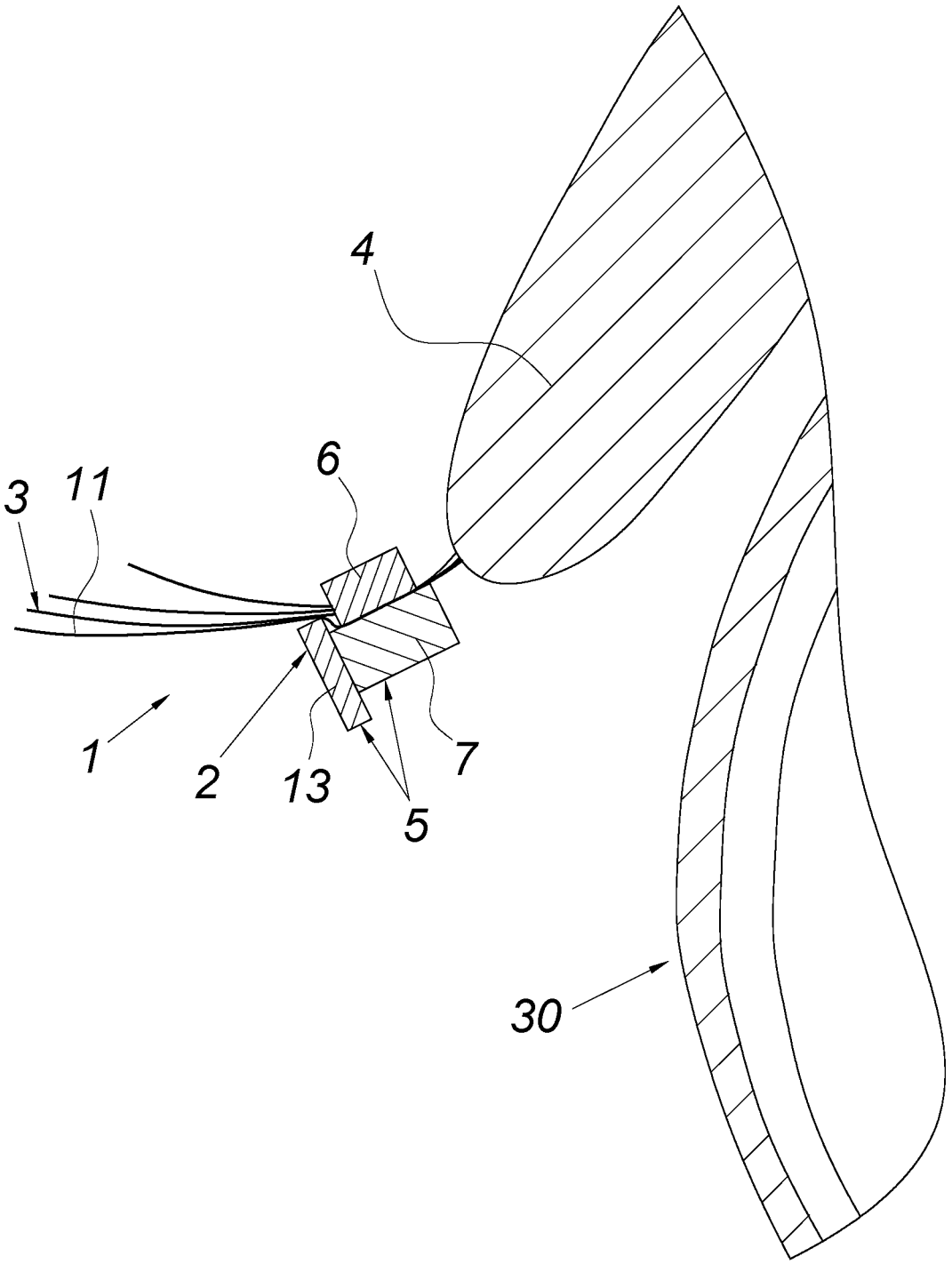
FIGS. 1 and 2 show enlarged cross-sectional views of the piece of eyelash jewelry according to the invention on an eye.

FIG. 1 shows a piece of eye lash jewelry 1 according to the invention for fastening jewelry elements 2 or decoration elements 2 to the eyelashes 3 of an eyelid 4—having a jewelry substrate 5 and a fastening part 6. The jewelry substrate 5 has a first magnetic means 7, which constitutes a first holding surface 8 on the jewelry substrate 5. The fastening part 6 in turn has a second magnetic means 9, which constitutes a second holding surface 10 on the fastening part 6. The jewelry substrate 5 is provided for a jewelry element 2 or decoration element 2 and for this purpose, can, for example, also have a socket or setting, not shown in detail, for the insertion of the jewelry element 2 or decoration element 2. In order to fasten the piece of eyelash jewelry 1 to the eyelashes 3 of an eyelid 4, the jewelry substrate 5 and fastening part 6 are positioned against each other with holding surfaces 8, 10 facing each other—in the exemplary embodiment, the fastening part 6 is positioned above the eyelashes 3 and the jewelry substrate 5 is positioned below them. The magnetic force of the magnetic means 7, 9, which acts via the holding surfaces 8, 10, thus acts along a holding direction 12 between the jewelry substrate 5 and the fastening part 6 in order to hold them together. In particular, in order to affix the piece of eyelash jewelry 1 to the eyelid 4, at least one eyelash 11 is clamped between the jewelry substrate 5 and the fastening part 6, which produces a durable securing of the position of the piece of eyelash jewelry 1. The magnetic means 7, 9, 16 in this case are preferably embodied in the form of permanent magnets 19 or by means of magnetic foils 20, as a result of which the holding surfaces 8, 10, 17 function as magnetic poles of the magnetic means 7, 9, 16.

Figure 2:
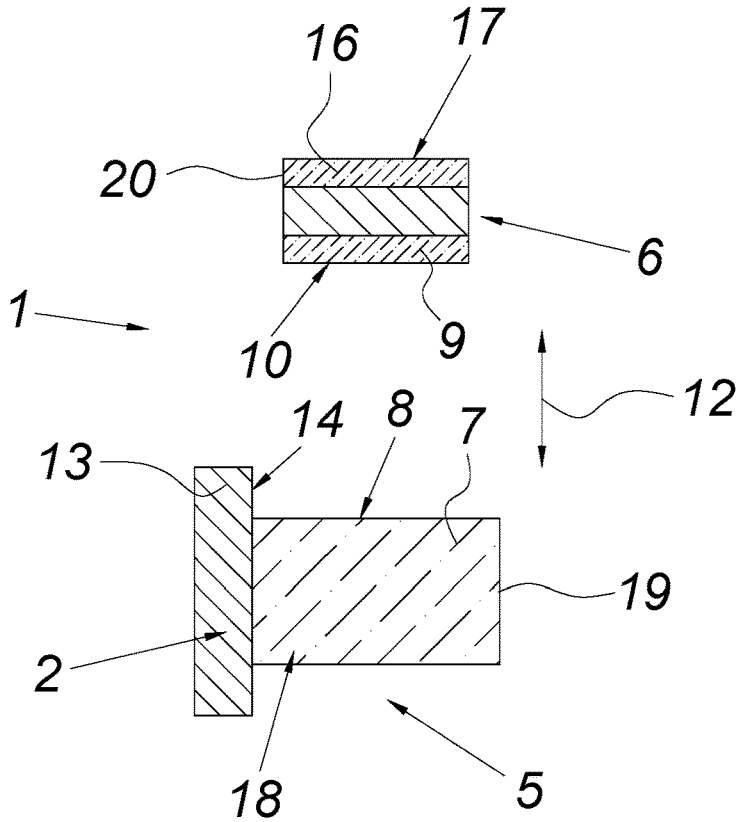

As shown in FIG. 2, the jewelry substrate 5 of the piece of eyelash jewelry 1 has a flange 13, which protrudes from the first holding surface 8 of the jewelry substrate 5. The flange 13 in this case extends at least partially in the holding direction 12 of the magnetic force between the jewelry substrate 5 and the fastening part 6. A different angle between the flange 13 and the first holding surface 8 can be selected as long as a stop 14 for the fastening part 6 is produced. In this case, the stop 14 prevents an unwanted pulling-off of the jewelry substrate 5 in the direction of the eye 30—and can thus prevent a risk of injury by means of the jewelry substrate 5 with a jewelry element 2 or decoration element 2—as well as an unwanted rotation of the jewelry substrate 5. This enables a durable orientation of the jewelry element 2 or decoration elements 2. In this case, the fastening part 6 can touch the flange 13 directly or can also touch the flange 13 indirectly via an eyelash 11 that is clamped between the fastening part 6 and the jewelry substrate 5. The flange 13 thus constitutes a stop 14 for the fastening part 6—whether directly or indirectly.

As shown in the detail view in FIG. 2, in a particular embodiment form, the flange 13 protrudes orthogonally from the first holding surface 8 of the jewelry substrate 5. Such an orthogonally protruding flange 13 achieves a particularly reliable stop and thus an increased degree of safety.

Figure 3:
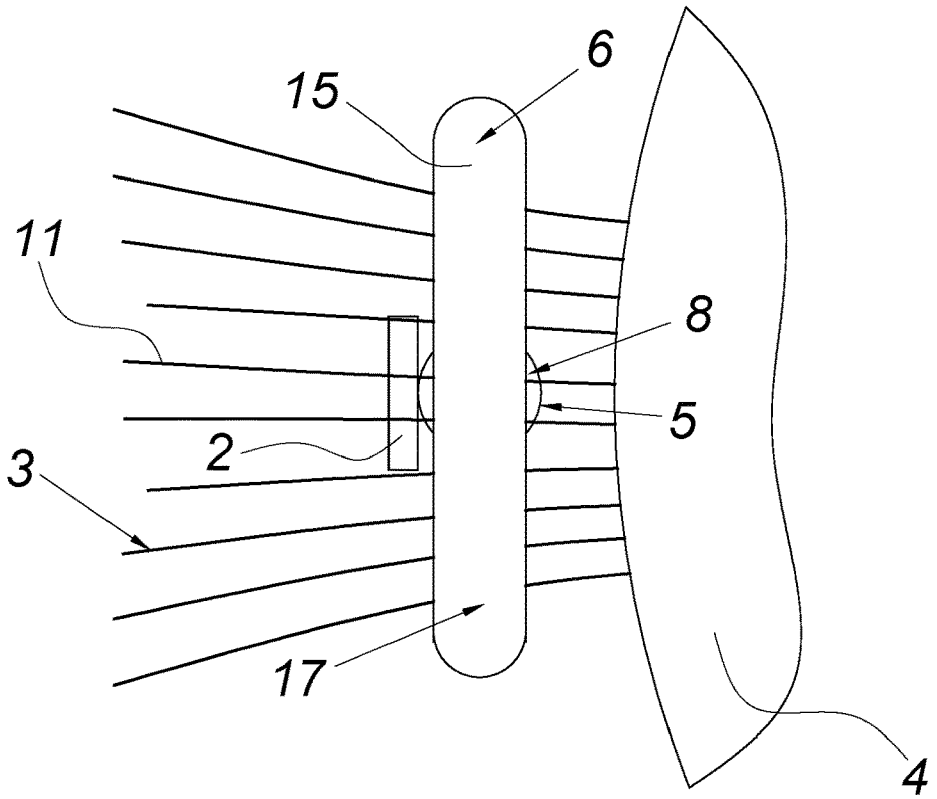
FIG. 3 shows an enlarged top view of the piece of eyelash jewelry according to the invention.

As shown in FIGS. 1-3, the flange 13 is embodied by means of a jewelry element 2 or decoration element 2 provided on the jewelry substrate 5. In particular, the jewelry element 2 or decoration element 2 in this case can be mounted on the jewelry substrate 5 and integrally joined to it by means of adhesive.

The jewelry substrate 5 has a base 18 to which the jewelry elements 2 or decoration elements 2 are fastened, which base 18 is constituted by the first magnetic means 7. The first magnetic means 7 in this case is preferably provided in the form of a neodymium/iron/boron permanent magnet 19.

As can be inferred in particular from FIG. 3, the fastening part 6 is embodied as an elongated rod 15 so that it rests on a plurality of lashes 11 of the eyelashes 3 of an eyelid 4. As a result, the weight of the fastening part 6 is distributed to and durably supported by a plurality of eyelashes 11. This in turn can improve the wearing comfort of the piece of eyelash jewelry 1.

It is also clear from FIGS. 2 and 3 that the fastening part 6 has a third magnetic means 16 with a third holding surface 17, which is positioned on the second side of the fastening part 6 opposite from the second holding surface 10. The fastening part 6 embodied as an elongated rod 15 can thus cooperate with the first magnetic means 7 of the jewelry substrate 5 on both sides, i.e. both via its second magnetic means 9 and via its third magnetic means 16, to secure the piece of eyelash jewelry 1 to an eyelid 4. The fastening part 6 in this case can be embodied by a two-sided magnetic foil 20 or metal foil 20, which simultaneously constitutes the second and third magnetic means 9, 16. In the same way, the fastening part 6 can also be produced by means of two magnetic foils or metal foils 20 that are placed against each other, but this is not shown in detail in the figures.

The jewelry substrate 6 is embodied as T-shaped in cross-section, which makes it easier to use, as is apparent from FIG. 2.

The invention claimed is:

1. A piece of eyelash jewelry, comprising:

a jewelry substrate, which has a first magnetic portion with a first holding surface, and a fastening part, which has a second magnetic portion with a polarity that is opposite from a polarity of the first magnetic portion, and the second magnetic portion has a second holding surface, wherein the first magnetic portion of the jewelry substrate and the second magnetic portion of the fastening part interact magnetically to clamp at least one eyelash that can be placed between their opposing holding surfaces in order to thus fasten the piece of eyelash jewelry to the at least one eyelash, and the jewelry substrate has a flange, which protrudes from the first holding surface and thus forms a stop for the fastening part.

2. The piece of eyelash jewelry according to claim 1, wherein the flange protrudes from the first holding surface inclined at an angle.

3. The piece of eyelash jewelry according to claim 1, wherein the jewelry substrate has a jewelry element or other decoration element that constitutes the flange.

4. The piece of eyelash jewelry according to claim 1, wherein the first and second holding surfaces comprise magnetic poles of the respective magnetic portions.

5. The piece of eyelash jewelry according to claim 1, wherein the jewelry substrate has a base from which the flange protrudes and which has the first holding surface.

6. The piece of eyelash jewelry according to claim 5, wherein the first magnetic portion constitutes the base.

7. The piece of eyelash jewelry according to claim 1, wherein the first magnetic portion is a permanent magnet.

8. The piece of eyelash jewelry according to claim 1, wherein the fastening part is elongated.

9. The piece of eyelash jewelry according to claim 1, wherein the fastening part has a third magnetic portion with a third holding surface, which is provided on a side of the fastening part opposite from the second holding surface.

10. The piece of eyelash jewelry according to claim 1, wherein the fastening part is composed of at least one magnetic foil or metal foil.

11. The piece of eyelash jewelry according to claim 1, wherein the jewelry substrate is L-shaped or T-shaped in cross-section.

* * * * *